US006464523B1

(12) United States Patent
LeVine

(10) Patent No.: US 6,464,523 B1
(45) Date of Patent: Oct. 15, 2002

(54) WATERTIGHT ELECTRICAL CABLE CONNECTOR

(75) Inventor: Edward LeVine, Vista, CA (US)

(73) Assignee: Northrop Grumman Corporation, Woodland Hills, CA (US)

( * ) Notice: Subject to any disclaimer, the term of this patent is extended or adjusted under 35 U.S.C. 154(b) by 0 days.

(21) Appl. No.: 09/860,986

(22) Filed: May 18, 2001

(51) Int. Cl.[7] ..... H01R 13/52
(52) U.S. Cl. ..... 439/271; 439/926
(58) Field of Search ..... 439/271, 275, 439/277, 587, 588, 589, 272, 283, 926, 76.1, 76.2, 551, 95

(56) References Cited

U.S. PATENT DOCUMENTS 3,986,765 A * 10/1976 Shaffer et al. ..... 439/588
4,588,247 A * 5/1986 Grappe et al. ..... 439/271
4,738,628 A * 4/1988 Rees ..... 439/95
5,902,150 A * 5/1999 Sigl et al. ..... 439/587
6,116,952 A * 9/2000 Nakata ..... 439/587

* cited by examiner

*Primary Examiner*—Javaid Nasri
(74) *Attorney, Agent, or Firm*—Price and Gess

(57) ABSTRACT

An electrical connector forming a watertight seal once connected. The connector includes a receptacle formed within a first housing and having a plurality of electrically conductive sockets disposed in an insulator for receiving electrically conductive pins. Also, a plug is adapted for receipt by the receptacle and is formed within a second housing and has a plurality of electrically conductive pins no greater in number than the number of the electrically conductive sockets. The connector has an insulating "O" ring disposed between the sleeve and the second housing with a diameter equal to the diameter of said first housing, whereby the "O" ring forms a watertight seal between the receptacle and the plug.

3 Claims, 2 Drawing Sheets

WATERTIGHT ELECTRICAL CABLE CONNECTOR

BACKGROUND OF THE INVENTION

1. Field of the Invention

The present invention relates to an electrical cable connector apparatus that forms a watertight seal once connected.

2. Description of Related Art

Electrical cable connectors come in all sizes and shapes and serve a variety of purposes; the most important of which is to make an effective electrical connection, whether the cable is for high voltage, low voltage, high frequency or low frequency. Prior art electrical cable connectors suffer from the same problem, which is lack of watertight integrity. For example, water can cause serious damage to an electrical connection. While some connectors may be satisfactory for humid environments, they are not satisfactory when the cable may be immersed in a liquid for an extended period of time.

Therefore, a need exists for an electrical cable connector and receptacle therefor that forms an effective electrical connection (i.e., makes a good ohmic contact) while at the same time one that is impervious to liquids. That is, there is a need for cable connectors that can be submerged in a liquid.

SUMMARY OF THE INVENTION

The present invention provides a watertight electrical connector that also maintains an effective electrical connection.

These and other features, which will become apparent as the invention is described in detail below, are provided by an electrical connector forming a watertight seal once connected. The connector includes a receptacle formed within a first housing and having a plurality of electrically conductive sockets disposed in an insulator for receiving electrically conductive pins. Also, a plug is adapted for receipt by the receptacle and is formed within a second housing and has a plurality of electrically conductive pins no greater in number than the number of the electrically conductive sockets. The connector has an insulating "O" ring disposed between the sleeve and the second housing with a diameter equal to the diameter of said first housing, whereby the "O" ring forms a watertight seal between the receptacle and the plug.

Still other features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out the invention. Various modifications, however, will remain readily apparent to those skilled in the art, since the general principles of the present invention have been defined herein specifically to provide a watertight electrical cable connector and receptacle therefor, which are simple to manufacture and easy to use.

Figure 1A:
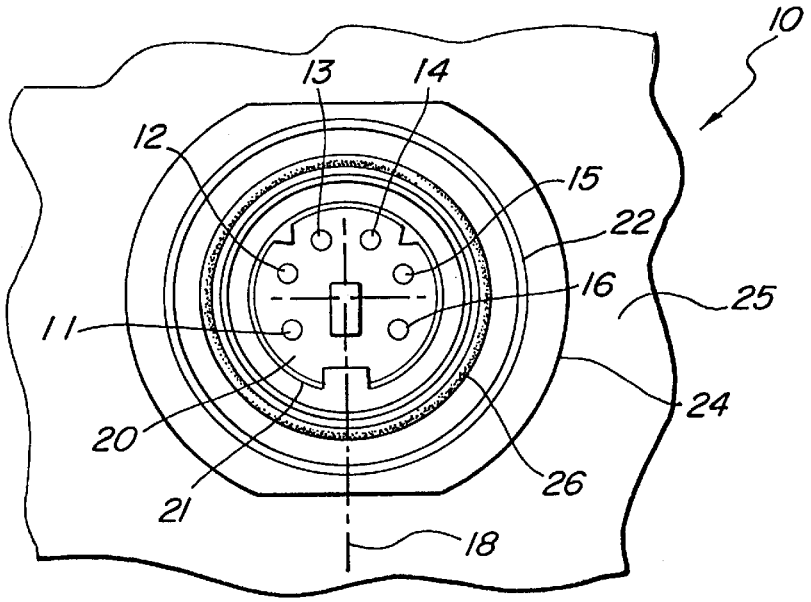
FIG. 1A illustrates a plan view of an electrical connector receptacle in accordance with the teachings of the present invention.
Figure 1B:
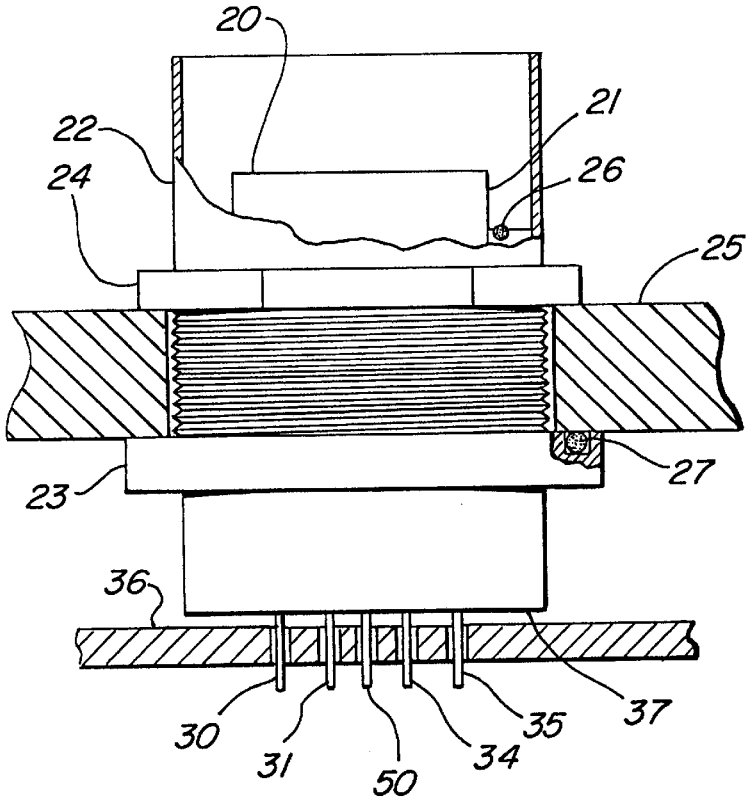
FIG. 1B illustrates a cross-sectional view of the electrical connector receptacle shown in FIG. 1A.

Referring now to the drawings and to FIGS. 1A and 1B in particular, plan and partial cross-sectional views of an electrical connector receptacle 10 constructed in accordance with the principles of the present invention are shown. FIG. 1A illustrates the plan view of the connector receptacle 10, and FIG. 1B illustrates the partially cut-away side view of the same connector receptacle. As can be seen in the FIG. 1A, a plurality of electrical connection sockets 11, 12, 13, 14, 15 and 16 are located concentrically about a center-line 18 of the connector 10. The sockets 11–16 are located within an insulator 20, which is surrounded by a conductive sleeve 21. The insulator 20 and sleeve 21 are both concentric with the center-line 18. The connector is enclosed within a housing 22 having a shoulder 23. The sleeve 21,which is made of aluminum or stainless steel, is connected to a ground pin 50 as shown in FIG. 1B.

In accordance with the illustrated embodiment, the housing 22 has threaded thereon a locking nut 24, which secures the connector 10 to a support 25. A first "O" ring 26 is located inside between the sleeve 21 and the housing 22, and may be attached to the surface of the housing as shown by means of epoxy. The "O" ring 26 may be made of silicone or Teflon or butyl rubber. However, I have discovered that butyl rubber is a preferred material to use, which "O" ring may be acquired from the Parker Seal Company of Cleveland, Ohio. A second "O" ring 27 is located outside the housing and on a mating surface of the shoulder 23. The housing 22 may be fabricated with aluminum or cast aluminum or stainless steel.

Accordingly, when the connector 10 is mounted to the support 25, the nut 24 is cinched down for holding the connector in place. The "O" ring 26 forms a seal making the joint between the connector receptacle and a mating plug watertight. Note that the portion of the connector housing 22 above the support 25 (when the drawing is viewed in a conventional manner) may be immersed in a liquid. On the lower side of the connector 10, on the end opposite the sockets 11–16, connection pins 30, 31, 32, 33, 34 and 35 are disposed for electrical connection or, as shown, receipt by vias in a circuit board 36. The ground pin 50 is located in the center of the receptacle and is also received by a via in the circuit board 36. To help maintain the watertight integrity of the connector receptacle 10, the bottom thereof is sealed at a surface 37.

Figure 2A:
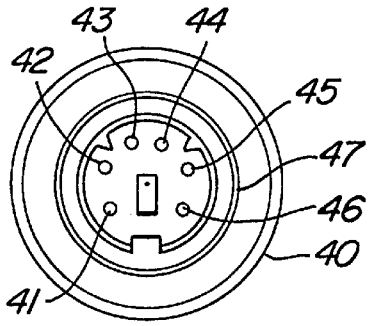
FIG. 2A illustrates a plan view of a male connector having a straight "pig tail" adapted for use with the connector receptacle shown in FIGS. 1A and 1B.
Figure 2B:
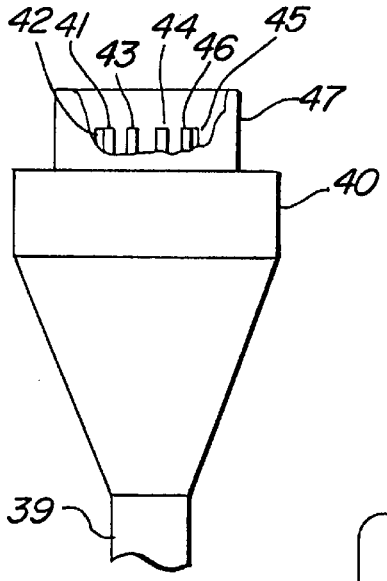
FIG. 2B illustrates a side (partially cut-away) view of the male connector shown in FIG. 2A.

Referring now to FIG. 2A, a plan view of a male connector 40 is shown adapted for use with the connector receptacle 10 and includes a straight "pig tail" 39. The connector 40 includes pins 41, 42, 43, 44, 45 and 46, which mate with the sockets 11–16 of the connector 10. The pins 41–46 are within a protective sleeve 47. The protective sleeve 47 is equi-diameter with the "O" ring 26 (FIG. 1), and when the connector 40 is joined with the connector receptacle 10 a watertight seal is formed. This same male connector 40 is shown in a partially cut-away side view in FIG. 2B, wherein like reference numerals are used.

Figure 3A:
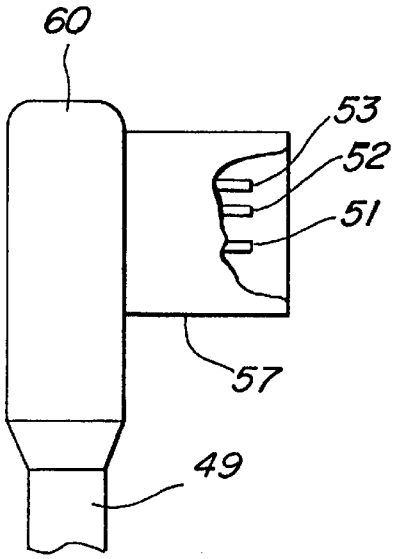
FIG. 3A illustrates a side (partially cut-away) view of another type of male connector with a right angle "pig tail" adapted for use with the connector receptacle shown in FIGS. 1*a* and 1B.
Figure 3B:
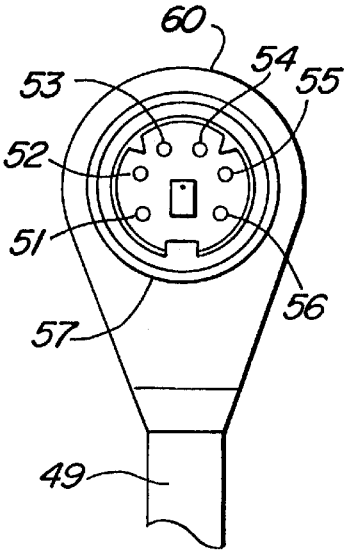
FIG. 3B illustrates a plan view of the male connector shown in FIG. 3A.

Referring now to FIG. 3A, a plan view of another type of male connector 60 is shown for use with the connector receptacle 10 and includes a right angle "pig tail" 49. The connector 60 includes pins 51, 52, 53, 54, 55, and 56, which mate with the sockets 11–16 of the connector 10. The pins 51–56 are within a protective sleeve 57. The protective sleeve 57 is equi-diameter with the "O" ring 26 (FIG. 1), and when the connector 60 is joined together with the connector receptacle 10 a watertight seal is formed. This same male connector 60 is shown in a partially cut-away side view in FIG. $3B_1$ wherein like reference numerals are used.

While the invention has been particularly shown and described with reference to a preferred embodiment, it will be understood by those skilled in the art that various changes in form and detail may be made therein without departing from the spirit and scope of the invention.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An electrical connector, said connector comprising:

a receptacle formed within a first housing and having a plurality of electrically conductive sockets disposed in an insulator for receiving electrically conductive pins, said insulator being surrounded by a sleeve;

a locking nut;

said first housing having a plurality of threads for receiving said locking nut thereon for securing said receptacle to a circuit board;

a plug formed within a second housing and having a plurality of electrically conductive pins; and, an O ring disposed between said sleeve and said first housing and having a diameter substantially equal to the diameter of said second housing, whereby said O ring forms a seal between said receptacle and said plug.

2. A cable connector, said connector comprising:

a receptacle formed within a first housing and having a plurality of electrically conductive sockets disposed in an insulator for receiving electrically conductive pins, said insulator being surrounded by a sleeve;

a locking nut;

said first housing having a plurality of threads for receiving said locking nut thereon for securing said receptacle to a circuit board;

a plug formed within a second housing and having a plurality of electrically conductive pins; and, an O ring disposed between said sleeve and said first housing and having a diameter substantially equal to the diameter of said second housing, whereby said O ring forms a seal between said receptacle and said plug.

3. The cable connector of claim 2 wherein said first housing further comprises a plurality of electrically conductive connection pins adapted for receipt by and disposed for an electrical connection with the circuit board.

* * * * *